US006042318A

United States Patent [19]

Ferrante

[11] Patent Number: 6,042,318

[45] Date of Patent: Mar. 28, 2000

[54] BOOKBINDING SYSTEM EMPLOYING MICROWAVE HEATING

[75] Inventor: John L. Ferrante, Williamsport, N.Y.

[73] Assignee: Xerox Corporation, Stamford, Conn.

[21] Appl. No.: 08/885,210

[22] Filed: Jun. 30, 1997

[51] Int. Cl.[7] ..... B42C 9/00

[52] U.S. Cl. ..... 412/8; 412/41

[58] Field of Search ..... 412/8, 37, 36, 412/41, 902; 219/678; 204/193

[56] References Cited

U.S. PATENT DOCUMENTS

| | | | |
|---|---|---|---|
| 3,928,119 | 12/1975 | Sarring | 156/477 |
| 5,210,176 | 5/1993 | Bhatia et al. | 412/8 |
| 5,213,871 | 5/1993 | VanBortel et al. | 428/819 |
| 5,316,424 | 5/1994 | Luhman et al. | 412/902 X |
| 5,346,350 | 9/1994 | Luhman et al. | 412/902 X |
| 5,570,985 | 11/1996 | Latvakangas et al. | 412/902 X |

FOREIGN PATENT DOCUMENTS

| | | |
|---|---|---|
| 0 390 733 | 10/1990 | European Pat. Off. . |
| 2 568 185 | 1/1986 | France . |
| 20 05 961 | 11/1970 | Germany . |

*Primary Examiner*—Willmon Fridie, Jr.

[57] ABSTRACT

A microwave binder is used in conjunction with paper tape which is coated with one or more formulations of encapsulated, fast setting, water soluble adhesives to bind pages of a book. The tape spine adhesive is of sufficient thickness to allow it to penetrate into the edges of the pages of the bound edge. The microwave heating causes the capsules to rupture, releasing the adhesives to flow into the bound edge of the book.

10 Claims, 2 Drawing Sheets

BOOKBINDING SYSTEM EMPLOYING MICROWAVE HEATING

Cross reference is hereby made to related, commonly assigned, application Ser. No. 08/885,205, filed concurrently herewith in the name of John L. Ferrante et al. and entitled MICROWAVE BOOKBINDER TAPE.

BACKGROUND OF THE INVENTION

1. Field of the Invention

This invention relates to bookbinding, and more particularly, to an improved system for bookbinding that employs an adhesive that is microwave heated to bind pages of a book together.

2. Description of the Prior Art

Typical current Bookbinding systems include equipment that utilizes heated surfaces which comes into contact with a tape substrate coated with hot melt adhesive, as shown for example, in U.S. Pat. No. 3,928,119 where an adhesive bearing strip is driven, by relative motion between a stack of sheets and spaced platens, between the heated platens by the stack. In machines of this type, the heated platens are subsequently moved toward each other to move and press the adhesive strip to the stack of sheets. A moisture proof binding tape for edge binding pages to form a book in shown in U.S. Pat. No. 5,213,871 that consisting of a non-permeable temperature resistant foil layer covering one side of the backing strip forming a moisture barrier, a high temperature steam resistance adhesive between the foil layer and the backing strip to secure the foil layer to the backing strip, and a relatively thick central stripe of high tack heat activated adhesive flanked by relatively thin side stripes of low tack heat activated adhesive on the foil layer, the central adhesive stripe comprising a non-hygroscopic adhesive. Some disadvantages of systems of this type include: the high energy consumption (i.e., maintained at a specific temperature, for example, about 400° F.); the relatively long dwell time to fluidize the adhesive; and the difficulty in recycling bound books. The above-mentioned patents are incorporated herein by reference to the extent necessary to practice the present invention.

Thus, there is still a clear need for an improved bookbinding system that answers the above-mentions problems.

SUMMARY OF THE INVENTION

Accordingly, a bookbinding system is disclosed that includes a microwave heater having a pair of movable jaws for holding a book in a predetermined position, and a tape that includes a water soluble adhesive that surrounds the spine portion of a book to be bound. Upon activation of the microwave heater, the adhesive reacts to microwave energy to penetrate into edges of pages of the book to bind them together in the book.

DESCRIPTION OF THE DRAWINGS

All of the above-mentioned features and other advantages will be apparent from the example of one specific apparatus and its operation described hereinbelow. The invention will be better understood by reference to the following description of this one specific embodiment thereof, which includes the following drawing figures (approximately to scale) wherein.

DETAILED DESCRIPTION OF THE PREFERRED EMBODIMENT

The invention will now be described by reference to a preferred embodiment of the microwave bookbinding system of the present invention preferably for use in a conventional copier/printer. However, it should be understood that the bookbinding system of the present invention could be used with a stand alone apparatus or with any machine environment in which binding of sheets is desired.

Figure 1:
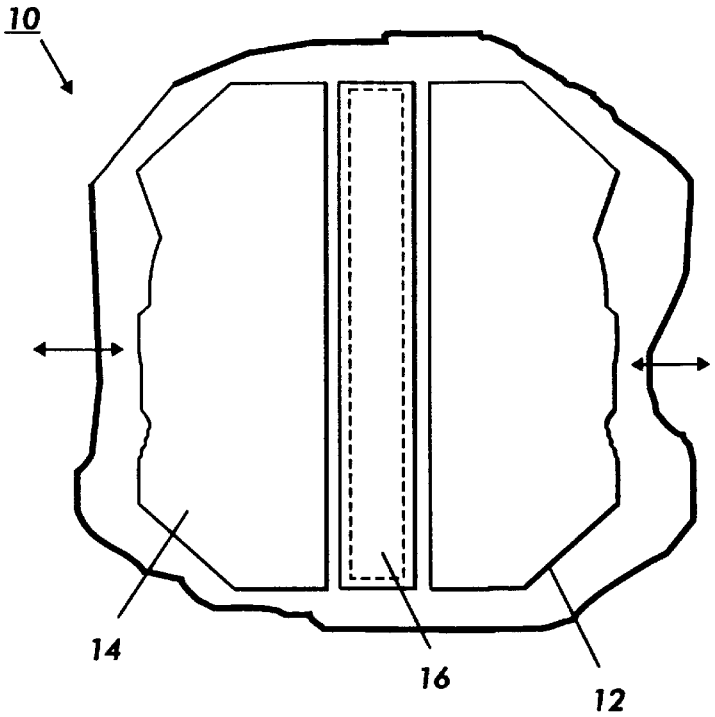
FIG. 1 is a schematic top view of binder incorporating the features of the present invention.
Figure 2:
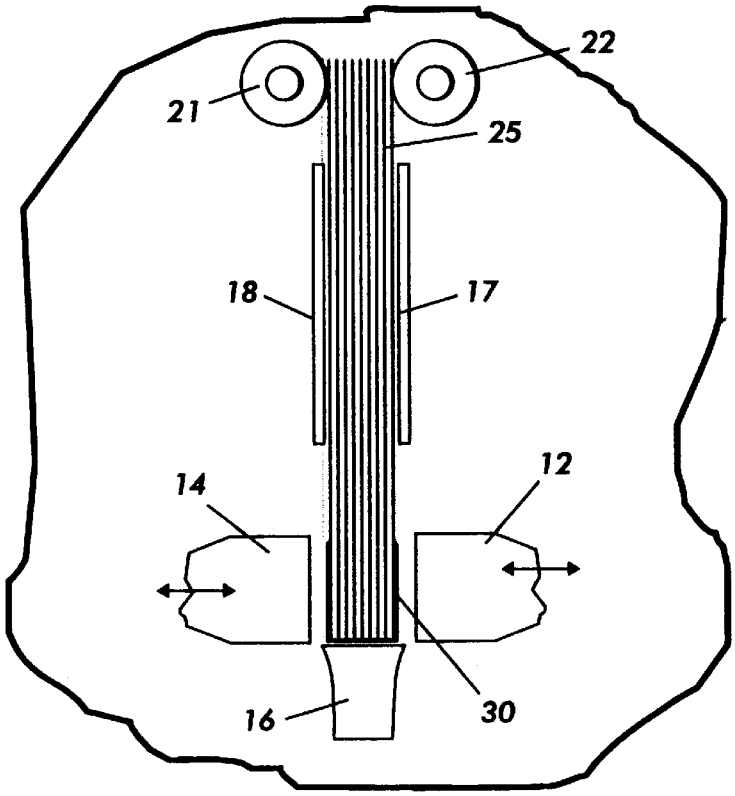
FIG. 2 is a schematic end view of the binder apparatus of FIG. 1.

For a general understanding of the features of the present invention, reference is made to the drawings. In the drawings like reference numerals have been used throughout to designate identical elements. FIGS. 1 and 2 schematically depict the bookbinding method and apparatus of the present invention.

Describing in further detail, the exemplary microwave apparatus 10 comprises flap heater/pressure jaws 12 and 14 positioned to heat the sides of a tape 30 shown in FIG. 2, while spine heater 16 is positioned to heat that portion of tape 30 that is covering the spine of book 25. Book guides 17 and 18 maintain book 25 in a predetermined position within microwave apparatus 10. Rollers 21 and 22 are used to feed book 25 into position to receive tape 30 along the spine and adjacent sides of the book. The process of binding books with this system is potentially safer and more energy efficient than thermal binding. Rollers could be used instead of jaws 12 and 14 to perform the pressing function, if desired.

In use, a book 25 is fed between guides 17 and 18 by feed rollers 21 and 22 until the spine of the book approximates a horizontal plane along the lower edge of flap/pressure jaws 12 and 14 and comes to rest against binder tape 30. Binder tape 30 has a portion thereof forced upward on either sides of book 25. Flap heater/pressure jaws 12 and 14 and spine heater 16 are then moved into contact with tape 30 while microwave heater 10 is simultaneously activated to apply microwave energy to the heaters. With binder tape 30 being made of paper and coated with one or more formulations of encapsulated, fast setting, water based adhesives, the microwave heating will allow the capsules to rupture, releasing the adhesive to penetrate into the edges of pages on the book on the bound edge. References to water based adhesives are intended to cover the general category of thermal plastic acrylic adhesives. The use of microwaves to bind books has been experimentally proven by taking a hot melt adhesive from a conventional Xerox™ 5090 binder tape that includes a vinyl acetate (EVA) flap adhesive and poly amide spine adhesive that is mounted on a latex saturated sheet of paper. These adhesives can be obtained from National Starch, 4079 Senator Street, Memphis, Tenn. 38118. This laminate was then placed on an unbound book and the book then placed in a CEM Corporation AVC80 solid generator microwave oven at 630 watts for 2 minutes. An 11 inch clip was used to hold the binder tape composite on the book during the oven exposure.

Figure 3:
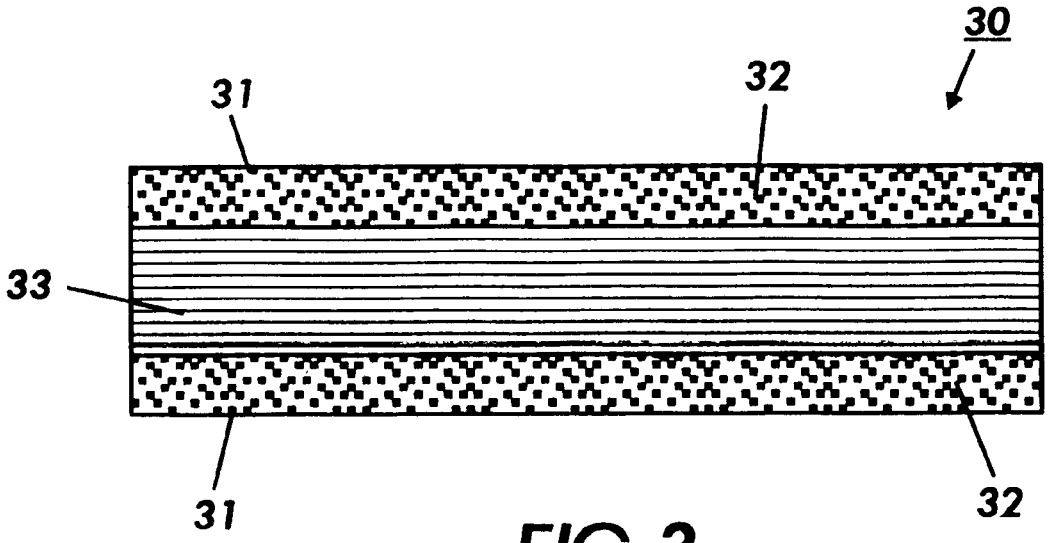
FIG. 3 is an enlarged, schematic top view of the binder tape used with the binder of FIG. 1.

Referring to FIG. 3 of the drawings, numeral 30 designates generally a binding tape of the type used to adhesively bind pages together to form a book, In the example shown, tape 30 comprises a length or strip 31 of formable backing or substrate material consisting of relatively heavy paper stock bearing microwave energy activated adhesive coatings. Typically, tape 30 is in the form of a roll (not shown) that is cut to desired length at the time of use. Normally, the length to which tape 30 is cut when binding is substantially equal to the length of the pages of book 25 being bound, although other lengths may be contemplated. The width of the backing strip 31 is somewhat greater than thickness of book 25 to allow the sides or flaps of tape 30 to partially wrap around and be secured to the other pages or covers of the assembled book 25. Backing strip 31 may be of any desired thickness.

Figure 4:
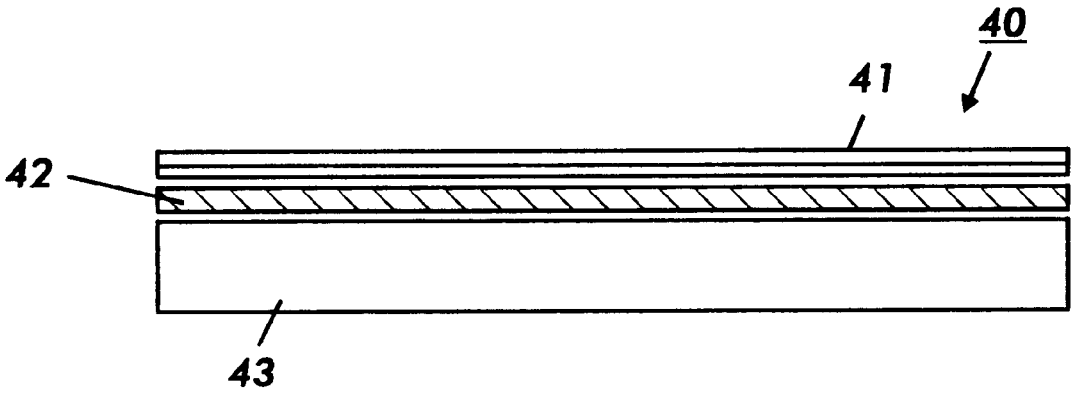
FIG. 4 is a schematic side view of a three part binder tape.
Figure 5:
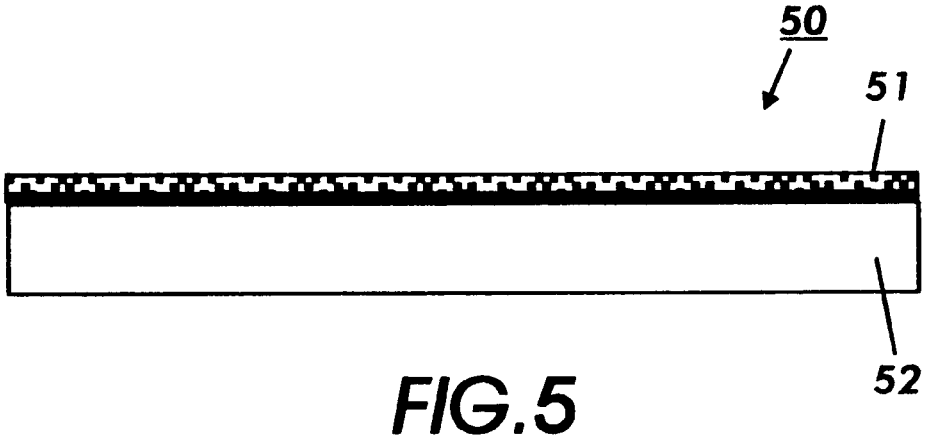
FIG. 5 is a schematic side view of an alternative two part binder tape.

Turning now more specifically to tape 30, it is shown in FIG. 3 as including a relatively thin ethylene vinyl acetate flap adhesive 32 of about 6 mils thick and a poly amide spine adhesive 33 of about 19 mils thick. The spine adhesive must be of sufficient thickness to allow it to penetrate into edges of the pages on the bound edge of the book. The adhesives are mounted on a paper base. An alternative three part tape is shown in FIG. 4 that includes a latex saturated base paper 43 onto which is positioned an aluminized coating 42. A hot melt, encapsulated, water based glue 41 is placed on top of the aluminized coating. The aluminized coating may be printed on the base paper or be on a separate carrier sheet which would be laminated to the base sheet prior to the addition of the adhesive. The aluminized coating converts the microwave energy into heat and distributes the heat evenly to the spine and flap adhesives producing a more consistent bind quality. It should be understood that other metalized coatings, such as zinc, which will generate heat when hit with microwaves can be used with excellent results. Another embodiment of a tape that is used effectively with the system of the present invention is shown in FIG. 5 that comprises a two part laminate tape 50 in the form of a latex saturated base paper 52 with a hot melt glue 51 with aluminum particles dispersed therein. The aluminum particles will allow for the even distribution of heat and a very short microwave binder cycle time. If desired, tape 50 can be used in the binding system of the present invention without the dispersed aluminum. In addition, it should be understood that any metalized particles, such as, zinc could be used in the present invention as long as they will generate heat when subjected to microwaves.

It should now be apparent that a method and apparatus that makes binding books easier and more cost effective has been shown and includes the use of a paper tape coated with an encapsulated water based adhesive positioned around the spin of pages of a book with this combination inserted into a microwave apparatus. Energy from the microwave melts the adhesive causing it to flow into the pages of the book to bind them to each other. Advantages of this system over thermal binding systems include: heat energy being required only during the binding period; microwave heating of the adhesive requires much shorter dwell time during the binding sequence; and with the adhesive being water based, recycling of bound books is possible.

While the embodiment shown herein is preferred, it will be appreciated that it is merely one example, and that various alterations, modifications, variations or improvements thereon may be made by those skilled in the art from this teaching, which is intended to be encompassed by the following claims:

What is claimed is:

1. A system for binding pages into a book, comprising:

a microwave heater that includes a pair of jaws with at least one of said jaws movable relative to the other for heating and pressuring a book therebetween; and a tape that covers a spine portion of a book, said tape including an adhesive that reacts to microwave energy such that activation of said microwave heater and said at least one movable jaw after said tape has been positioned to cover said spine portion of a book and the book positioned between said jaws causes said adhesive to penetrate into edges of pages of the book for binding them together.

2. The system of claim 1, wherein said adhesive is water soluble.

3. The system of claim 2, wherein said water soluble adhesive is encapsulated in a series of capsules and wherein said microwave heating causes said capsules to rupture, releasing said water soluble adhesive.

4. The system of claim 1, including guide members for positioning and maintaining a book in predetermined position within said microwave heater.

5. A system for binding pages into a book, comprising:

a microwave heater that includes a pair of heating and pressuring jaws and a spine heater; and a binder tape that covers a spine portion of a book, said tape including a water soluble adhesive that reacts to microwave energy such that activation of said microwave heater and said jaws after said tape has been positioned to cover the spine portion of a book and the book positioned between said jaws causes said water soluble adhesive to flow and penetrate into edges of pages of the book for binding pages together.

6. The system of claim 5, wherein said water soluble adhesive is encapsulated in a series of capsules and wherein said microwave heating causes said capsules to rupture, releasing said water soluble adhesive.

7. The system of claim 5, wherein said tape is made of paper.

8. A method for binding a plurality of unbound pages to create a bound book, comprising the steps of:

(a) providing a book of unbound pages;

(b) providing a microwave heater with a pair of heating and pressuring jaws;

(c) providing a tape with an adhesive that is microwave energy activatable;

(d) covering a spine portion of said book of unbound pages with said tape;

(e) positioning said book between said heating and pressuring jaws; and (f) activating said microwave heater while simultaneously pressuring said tape against said book with said heating and pressuring jaws to cause said adhesive to penetrate into edges of the pages of the book and bind them together.

9. The method of claim 8, including the step of making said adhesive water soluble.

10. The method of claim 9, said tape is made of paper.

* * * * *